US007815024B1

(12) United States Patent
Quimpo et al.

(10) Patent No.: US 7,815,024 B1
(45) Date of Patent: Oct. 19, 2010

(54) COLLAPSIBLE BALIKBAYAN BOX APPARATUS

(76) Inventors: Wilfredo B. Quimpo, 9653 Novara Ct., Stockton, CA (US) 95212; Camilo B. Cortes, 9653 Novara Ct., Stockton, CA (US) 95212; Honorio V. Fernandez, Jr., 9653 Novara Ct., Stockton, CA (US) 95212

( * ) Notice: Subject to any disclaimer, the term of this patent is extended or adjusted under 35 U.S.C. 154(b) by 10 days.

(21) Appl. No.: 11/695,524

(22) Filed: Apr. 2, 2007

(51) Int. Cl.
*A45C 7/00* (2006.01)
*A45C 13/10* (2006.01)

(52) U.S. Cl. ..... 190/107; 190/26; 190/902; 190/903; 229/203; 220/6; 383/61.1; 383/86; 383/97

(58) Field of Classification Search ..... 190/18 A, 190/26, 107, 902, 903; 383/86, 61, 97; 229/203; 220/6

See application file for complete search history.

(56) References Cited

U.S. PATENT DOCUMENTS 1,149,657 A * 8/1915 Loft ..... 229/78.2
2,425,035 A * 8/1947 Garnett et al. ..... 190/107
2,432,365 A * 12/1947 Allen ..... 190/115
2,756,923 A * 7/1956 Poppe ..... 229/77
3,325,084 A * 6/1967 Ausnit ..... 229/77
3,861,703 A 1/1975 Gould
3,965,952 A * 6/1976 Rivman et al. ..... 383/86
3,999,639 A 12/1976 Walters
4,126,213 A 11/1978 McDonald
4,170,282 A * 10/1979 Schwartzstein ..... 206/287.1
4,195,676 A * 4/1980 Walker ..... 190/124
4,951,818 A * 8/1990 Johnson ..... 206/315.1
5,896,962 A * 4/1999 Smith et al. ..... 190/107
7,175,010 B1 * 2/2007 Miner ..... 190/107
2002/0125090 A1 * 9/2002 Mercado et al. ..... 190/107
2002/0125669 A1 * 9/2002 Chang ..... 280/79.11
2003/0006110 A1 * 1/2003 Lin et al. ..... 190/18 A
2006/0065500 A1 * 3/2006 Herrig ..... 190/107
2006/0243365 A1 * 11/2006 Chiapuzio et al. ..... 150/154

* cited by examiner

*Primary Examiner*—Sue A Weaver
(74) *Attorney, Agent, or Firm*—Crossley Patent Law; Mark A. Crossley

(57) ABSTRACT

The collapsible balikbayan box apparatus is especially suited to surrounding and transporting a square cornered cardboard balikbayan box. The pliable ends, front, and back provide for collapse when the apparatus is not laden. The top is permanently affixed to the back and removably affixed to the two ends and the front. A unique hook latch provides for latch and release via stretching the pliable front and top. The rigid, removable bottom insert provides greater apparatus rigidity in use. Partially recessed wheels are fitted to the bottom. Straps encircle the bottom and extend up a majority of the sides, where the straps and handles are reinforced, so that the apparatus can be pulled or carried by the straps.

1 Claim, 5 Drawing Sheets

COLLAPSIBLE BALIKBAYAN BOX APPARATUS

BACKGROUND OF THE INVENTION

The art of suitcases is replete with a variety of both typical and specialized devices for transporting personal items. Further, collapsible suitcases and such are not rare in the art. However, specialized items for use with what are termed balikbayan boxes are not provided. A balikbayan box is a cardboard box, native to the Philippines, which is typically used to transport a plurality of items. Such boxes are typically shipped, via air freight or otherwise. The boxes are not especially sturdy, and the cardboard is unprotected. What is needed is a collapsible apparatus made in a plurality of sizes to fit snugly around a balikbayan box, and to provide further advantages in the handling and transport of such boxes.

FIELD OF THE INVENTION

The collapsible balikbayan box apparatus relates to suitcases and more especially to a specialized apparatus for covering and transporting a balikbayan box.

DESCRIPTION OF THE PRIOR ART

While related prior art fulfills various luggage needs, it does not specifically address the needs of transporting, carrying, and protecting a balikbayan box. For example, U.S. Pat. No. 4,126,213 issued to McDonald on 1978-11-21 teaches a collapsible suitcase with fold in side walls. The case provides far more complexity than the present apparatus, and therefore cannot be offered at the same reduced cost. Further, the rigid side walls cause the suitcase to weight more than the present apparatus. U.S. Pat. No. 3,861,703 issued to Gould on 1975-01-21 teaches a luggage carrier which detaches from a typical suitcase. U.S. Pat. No. 3,999,639 issued to Walters on 1976-12-28 teaches a soft-sided garment bag with personalized identification means.

While the above-described devices fulfill their respective and particular objects and requirements, they do not describe a collapsible balikbayan box apparatus that provides for the advantages of the collapsible balikbayan box apparatus. In this respect, the collapsible balikbayan box apparatus substantially departs from the conventional concepts and designs of the prior art. Therefore, a need exists for an improved collapsible balikbayan box apparatus.

SUMMARY OF THE INVENTION

The general purpose of the collapsible balikbayan box apparatus, described subsequently in greater detail, is to provide a collapsible balikbayan box apparatus which has many novel features that result in an improved collapsible balikbayan box apparatus which is not anticipated, rendered obvious, suggested, or even implied by prior art, either alone or in combination thereof.

To attain this, the collapsible balikbayan box apparatus comprises four pliable collapsible sides and a rigid bottom. The pliable top opens from the two opposed ends and the front and back via releasable fastening. Releasable fastening is provided in more than one embodiment. One embodiment of the apparatus provides hook and loop fastening of the top to the two ends and the front. Another embodiment of the apparatus provides zippered closure. The hook latch provides further increased closure integrity. The apparatus is provided for quick and easy inspection of the balikbayan box removably held within. The unique hook latch is quickly releasable. The latch flap is pliable and easily folds out of the way as needed. The rigid bottom is reinforced with a plurality of materials which include but are not limited to wood, plastics, and other synthetics and naturally occurring materials. The straps substantially surround the bottom and two ends, thereby providing support of the apparatus for carrying when laden. The reinforcements add integrity to the straps and to the handles. The straps and reinforcements prevent handle and end tears and other failures. The transparent holder provides for easy identification insertion. The square corners of the apparatus provide for best fit and support of the box within. When empty, the apparatus easily collapses toward the bottom to form a greatly reduced height. The collapsing process does not have to follow any specific order or form. The material choice for the sides and front and back provide for the same to simply collapse. The partially recessed wheels provide for ease of transport when the apparatus is laden but do not interfere easily by jutting too far outward, relatively. The partially recessed wheels are relatively less apt to hang in various grooves and cracks as would conventionally extended wheels and casters. The rigid insert is removably fitted within the bottom for added convenience of use.

Thus has been broadly outlined the more important features of the improved collapsible balikbayan box apparatus so that the detailed description thereof that follows may be better understood and in order that the present contribution to the art may be better appreciated.

An object of the collapsible balikbayan box apparatus is to be light weight.

Another object of the collapsible balikbayan box apparatus is to be inexpensively produced and sold.

A further object of the collapsible balikbayan box apparatus is to be easily used.

An added object of the collapsible balikbayan box apparatus is to provide square corners to match a box held within.

And, an object of the collapsible balikbayan box apparatus is to provide enhanced mobility via wheels.

Still another object of the collapsible balikbayan box apparatus is to provide proper support for carrying when laden.

These together with additional objects, features and advantages of the improved collapsible balikbayan box apparatus will be readily apparent to those of ordinary skill in the art upon reading the following detailed description of presently preferred, but nonetheless illustrative, embodiments of the improved collapsible balikbayan box apparatus when taken in conjunction with the accompanying drawings.

In this respect, before explaining the current embodiments of the improved collapsible balikbayan box apparatus in detail, it is to be understood that the collapsible balikbayan box apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved collapsible balikbayan box apparatus. It is therefore important that the claims be regarded as including such equivalent constructions insofar as they do not depart from the spirit and scope of the collapsible balikbayan box apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 6 thereof, the principles and concepts of the collapsible balikbayan box apparatus generally designated by the reference number 10 will be described.

Figure 2:
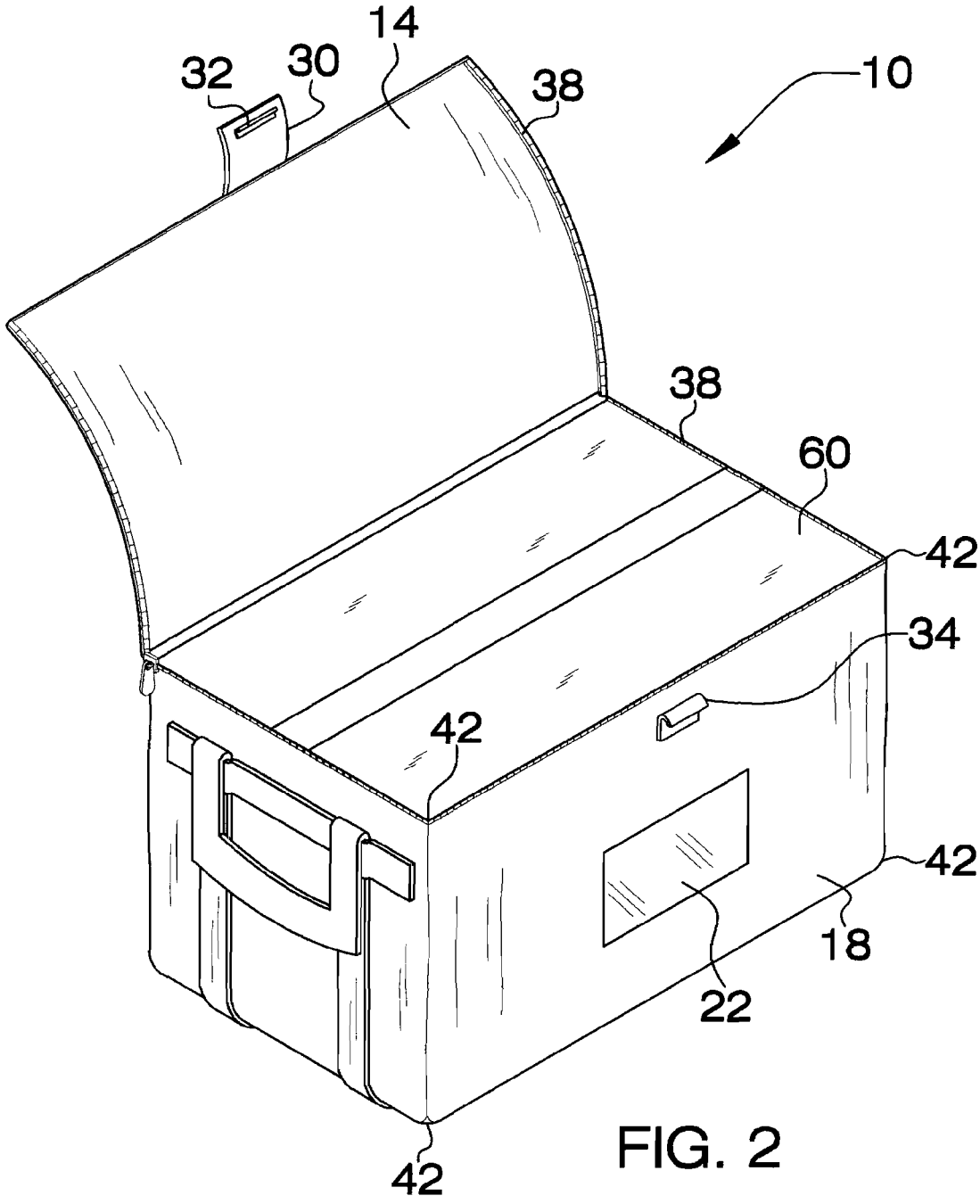
FIG. 2 is a perspective view of FIG. 1, with top shown in open position.

Referring to FIG. 2, the apparatus 10 provides for removable insertion of a balikbayan box 60. The square corners 42 of the apparatus properly match the square corners of the box 60. The first hook latch 32 provides quick release and latching to the second hook latch 34. The zipper 38 removably fastens the top 14 to the front 18 and the exterior ends 16. The top 14 is permanently affixed to the back 20.

Figure 1:
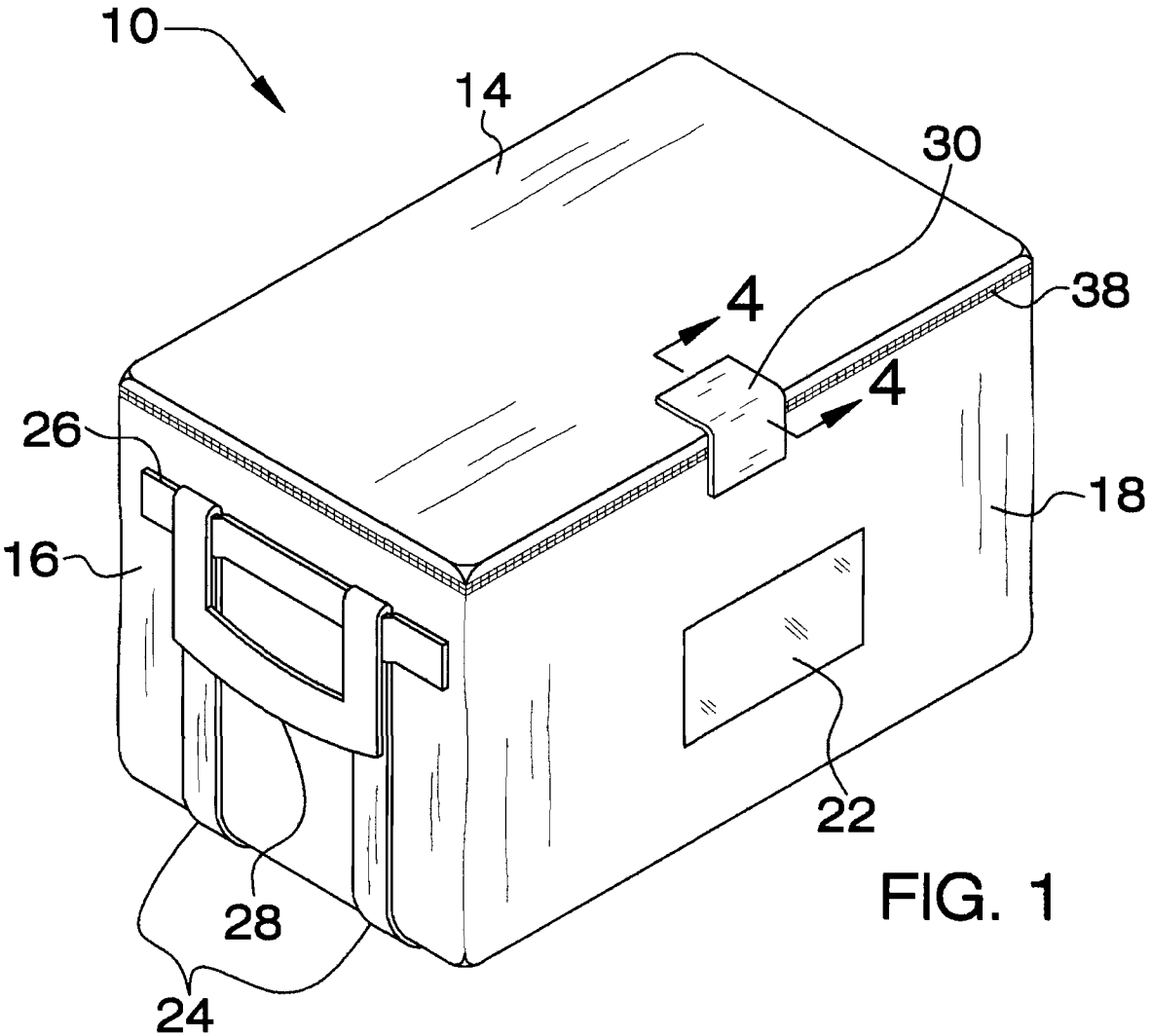
FIG. 1 is a perspective view of a rectangular shaped embodiment.
Figure 3:
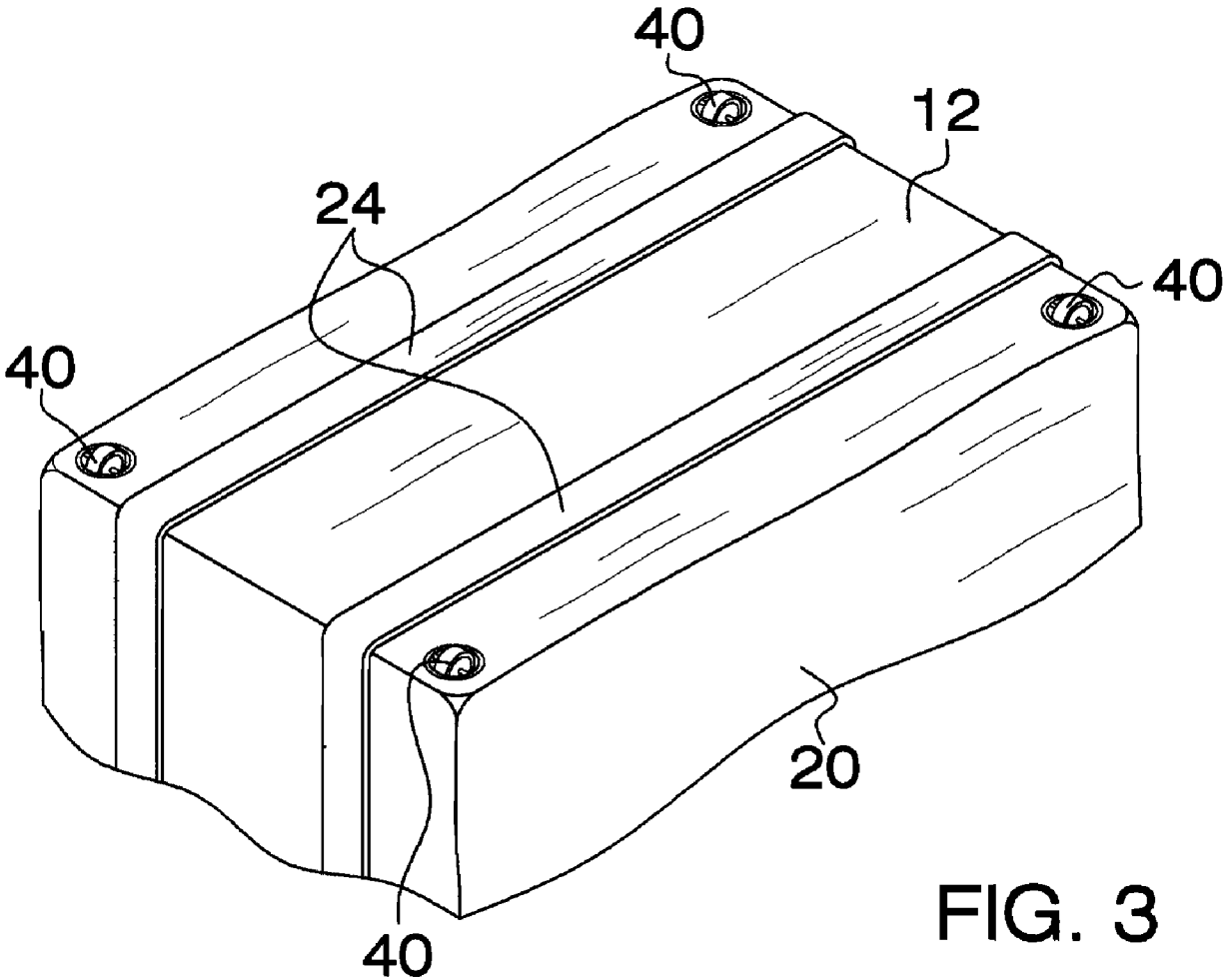
FIG. 3 is a partial bottom perspective view.
Figure 4:
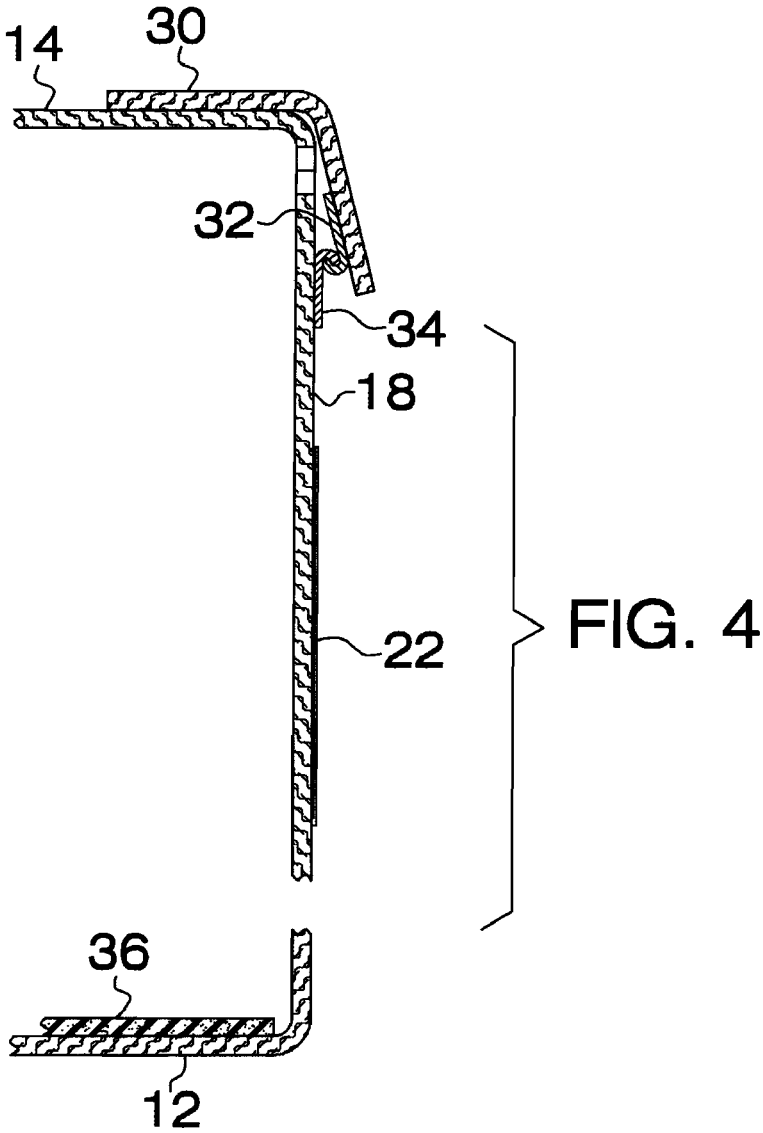
FIG. 4 is partial cross sectional view of FIG. 1.

Referring to FIGS. 1, 3, and 4, the apparatus 10 comprises fully pliable spaced apart exterior ends, the front spaced apart from the back, the bottom, and the top. The illustrated embodiment provides for releasably fastening the top 14 to the two exterior ends 16 and the front 18 via the zipper 38. The pliable latch flap 30 is affixed to the top14. The flap 30 selectively overlaps a portion of the front 18. The first hook latch 32 is affixed to the flap 30 overlapping the front 18. The second opposed hook latch 34 is affixed to the front 18. The second latch 34 removably receives the first latch 32. The transparent holder 22 is affixed to the front 18. The transparent holder 22 may be affixed to other exterior surfaces of the apparatus 10, such as one of the exterior ends 16 or the top 14. The pair of spaced apart straps 24 is provided. Each strap 24 is fastened to the bottom 12 and vertically to a majority of each end 16. Each strap 24 is affixed to a u-shaped handle 28 at each end of each strap 24. The reinforcement 26 is horizontally disposed across each end of each strap 24. Each reinforcement 26 is affixed to one of the exterior ends 16. The rigid removable bottom insert 36 is provided. The insert 36 provides cutouts (not shown) for the partially recessed wheels 40 that are provided at each corner of the bottom 12. Each wheel 40 is recessed to expose about one-half of each wheel 40.

Figure 5:
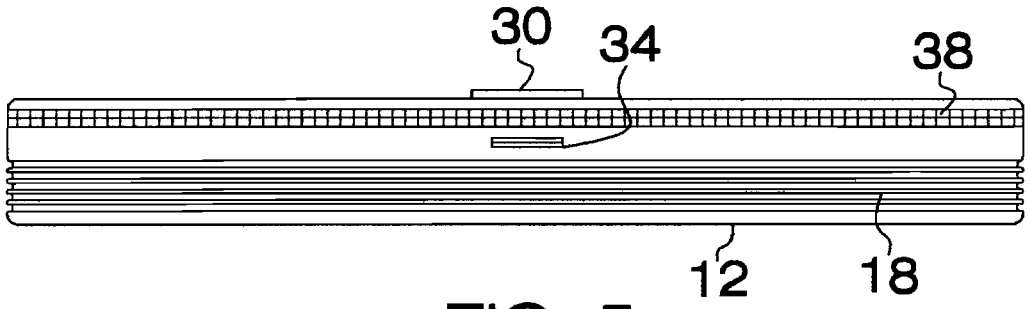
FIG. 5 is a frontal elevation view of the apparatus in a collapsed position.
Figure 6:
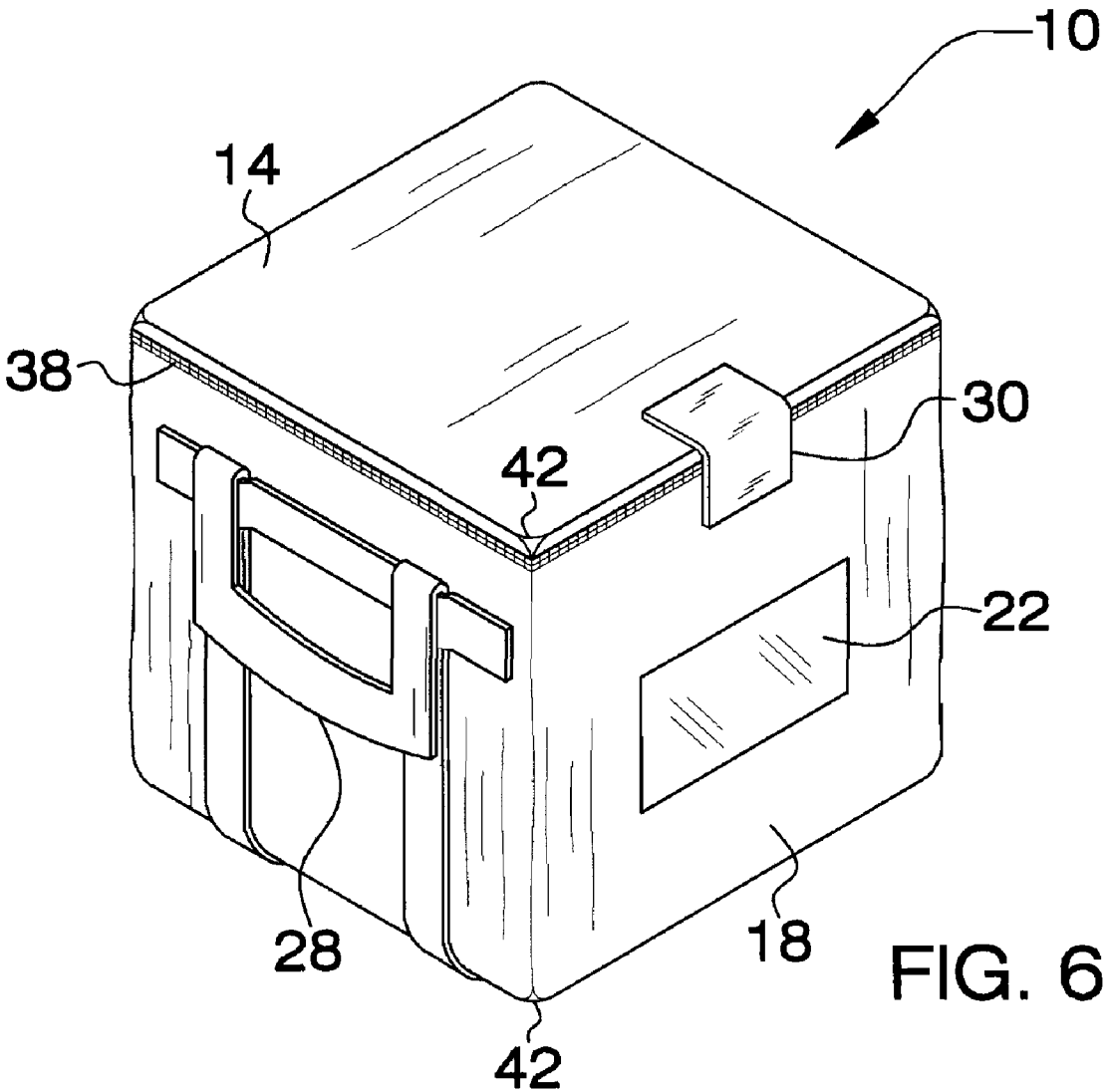
FIG. 6 is a perspective view of a square embodiment.

Referring to FIG. 5, the apparatus 10 holds no box 60. The exterior ends 16, back 20, and front 18 are free to collapse. The apparatus 10 thereby encompasses only a small fraction of expanded height. The apparatus 10 may thereby be easily transported or stored.

With respect to the above description then, it is to be realized that the optimum dimensional relationships for the parts of the collapsible balikbayan box apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the collapsible balikbayan box apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the collapsible balikbayan box apparatus may be used.

Therefore, the foregoing is considered as illustrative only of the principles of the collapsible balikbayan box apparatus. Further, since numerous modifications and changes will readily occur to those skilled in the art, it is not desired to limit the collapsible balikbayan box apparatus to the exact construction and operation shown and described, and accordingly, all suitable modifications and equivalents may be resorted to, falling within the scope of the collapsible balikbayan box apparatus.

What is claimed is:

1. A collapsible balikbayan box apparatus for selectively enclosing and transporting a balikbayan box, the apparatus comprising, in combination:

a square cornered pliable box with two spaced apart exterior ends, a front spaced apart from a back, a bottom, and a top affixed to the back;

means for releasably fastening the top to the two ends and the front;

a pliable latch flap affixed to the top, the flap selectively overlapping a portion of the front;

a first hook latch affixed to the flap overlapping the front;

a second opposed hook latch affixed to the front, the second latch removably receiving the first latch;

a pair of spaced apart straps, each strap fastened to the bottom and vertically to a majority of each end, each strap affixed to a u-shaped strap handle at an each end of each strap;

a reinforcement affixed horizontally across each end of each strap, each reinforcement affixed to one of the exterior ends;

a rigid bottom insert;

a balikbayan box removably contained within the apparatus;

wherein the means for releasably fastening the top to the two ends and the front further comprises a zipper and wherein the insert is removable further comprising a transparent holder affixed to the front.

* * * * *